US010857558B2

(12) United States Patent
Neill

(10) Patent No.: US 10,857,558 B2
(45) Date of Patent: Dec. 8, 2020

(54) COATING MATERIAL STORAGE BAG ORIENTATION CLIP AND COATING MATERIAL CARTRIDGE INCORPORATING THE SAME

(71) Applicant: Toyota Motor Engineering & Manufacturing North America, Inc., Plano, TX (US)

(72) Inventor: Jesse J. M. Neill, Atwood (CA)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 3 days.

(21) Appl. No.: 16/382,823

(22) Filed: Apr. 12, 2019

(65) Prior Publication Data

US 2020/0324308 A1 Oct. 15, 2020

(51) Int. Cl.

| | |
|---|---|
| ***B05B 15/60*** | (2018.01) |
| ***B05B 12/14*** | (2006.01) |
| ***B05B 9/04*** | (2006.01) |
| ***B05B 11/00*** | (2006.01) |

(52) U.S. Cl.

CPC ..... *B05B 12/1463* (2013.01); *B05B 9/04* (2013.01); *B05B 11/00414* (2018.08); *B05B 15/60* (2018.02)

(58) Field of Classification Search

CPC ..... B05B 12/1463; B05B 12/14; B05B 11/00414; B05B 11/00412; B05B 15/60; B05B 9/04

See application file for complete search history.

(56) References Cited

U.S. PATENT DOCUMENTS 3,270,920 A * 9/1966 Nessler ..... B05B 9/0833 222/95
4,423,583 A * 1/1984 Carey ..... B65B 43/465 493/206
6,276,788 B1 * 8/2001 Hilton ..... B41J 2/17513 347/86
7,156,045 B2 * 1/2007 Ueno ..... B05B 5/0407 118/300
7,611,102 B2 * 11/2009 Murray ..... B65B 43/465 141/391
7,931,171 B2 * 4/2011 Hamamura ..... B05B 5/1625 222/105
8,701,933 B2 * 4/2014 Thomason ..... B65D 77/067 141/114
8,899,447 B2 * 12/2014 Chassaing ..... B01F 13/1055 222/144
8,910,831 B2 * 12/2014 Williams ..... B05B 11/048 222/1
9,637,300 B2 * 5/2017 Dubois ..... B05B 9/0838
9,802,213 B2 * 10/2017 Joseph ..... B05B 7/066
(Continued)

*Primary Examiner* — Nicolas A Arnett
(74) *Attorney, Agent, or Firm* — Christopher G. Darrow; Darrow Mustafa PC

(57) ABSTRACT

A coating material cartridge includes an enclosure, a coating material storage bag received in the enclosure, and a coating material storage bag orientation clip secured within the enclosure. The clip engages a portion of the coating material storage bag to maintain the storage bag in a predetermined fixed orientation within the enclosure during filling of the coating material storage bag with coating material, and also during movement of the coating material cartridge.

11 Claims, 4 Drawing Sheets

(56) References Cited

U.S. PATENT DOCUMENTS

| | | | | |
|---|---|---|---|---|
| 10,370,237 | B2 * | 8/2019 | Blackburn | B05B 9/047 |
| 2006/0151061 | A1 * | 7/2006 | Lais | B65D 33/30<br>141/383 |
| 2013/0341381 | A1 * | 12/2013 | Thomason | B65D 25/28<br>229/117.09 |
| 2016/0251098 | A1 * | 9/2016 | Todd | B65B 31/00<br>141/4 |

* cited by examiner

FIG. 2B
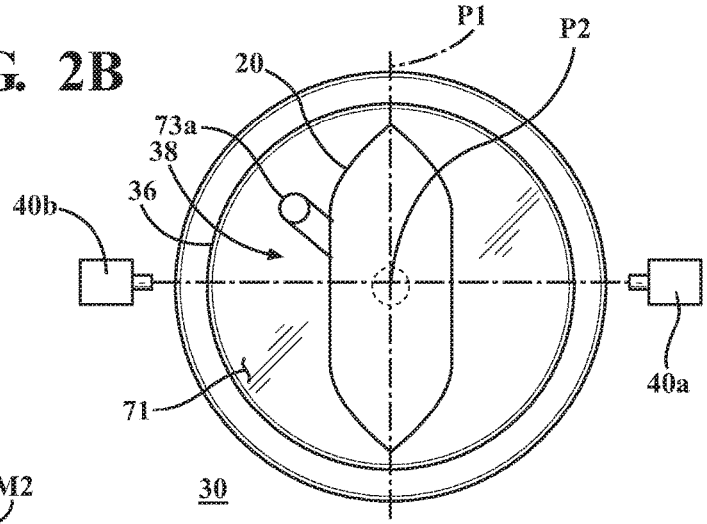
FIG. 2C
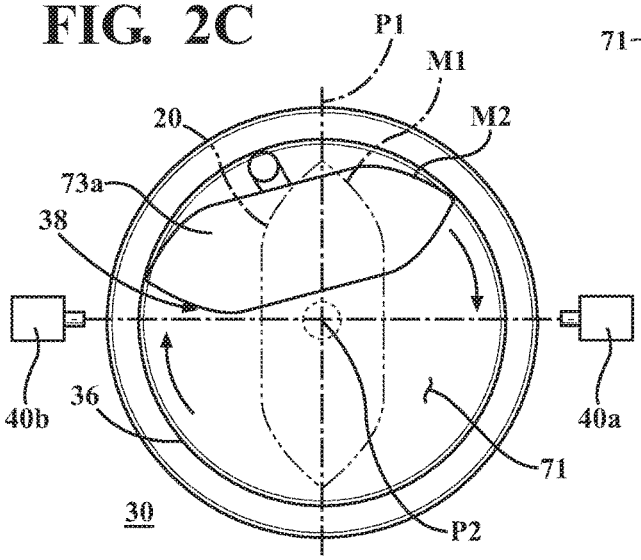
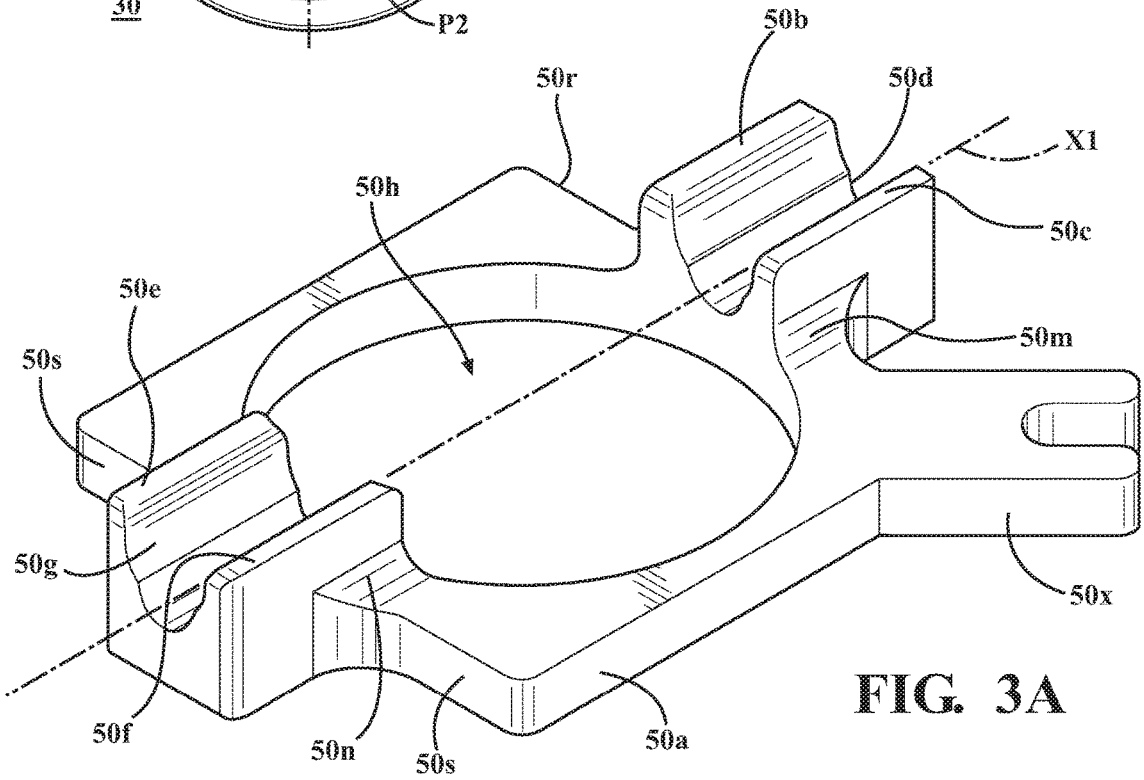
FIG. 3A

COATING MATERIAL STORAGE BAG ORIENTATION CLIP AND COATING MATERIAL CARTRIDGE INCORPORATING THE SAME

TECHNICAL FIELD

The present invention relates to industrial coating systems and, more particularly, to a mechanism for maintaining a coating material storage bag in a predetermined orientation within an enclosure of a coating material cartridge.

BACKGROUND

A conventional coating material cartridge may define an enclosure incorporating a coating material storage bag therein, for storing the coating material used in a coating process. The enclosure may serve as a positionable vessel for the coating material storage bag. The coating material storage bag may be filled (prior to the coating process) and also emptied (during the coating process) while positioned within the enclosure. In a conventional coating material cartridge, during filling of the coating material storage bag and also during extraction of coating material from the bag, the bag is unsecured within the enclosure and is free to move within the enclosure, subject to forces acting on the bag due to filling of the bag and movement of the cartridge. Due to the forces applied to the bag, at least a portion of the bag may rotate or twist inside the enclosure, which may interfere with extraction of coating material from the bag during the coating process.

SUMMARY

In one aspect of the embodiments described herein, a coating material cartridge is provided. The cartridge includes an enclosure, a coating material storage bag received in the enclosure, and a coating material storage bag orientation clip secured within the enclosure. The clip engages a portion of the coating material storage bag to maintain the storage bag in a predetermined fixed orientation within the enclosure.

In another aspect of the embodiments described herein, a coating material storage bag orientation clip is provided. The clip includes a base and a first pair of opposed walls extending from the base. The first pair of opposed walls forms a first slot therebetween. The first slot is configured to retain therein a portion of a coating material storage bag.

BRIEF DESCRIPTION OF THE DRAWINGS

FIG. 2B is a schematic plan view of the coating material cartridge and coating material storage bag shown in FIG. 2A positioned in an enclosure of the cartridge.

FIG. 2C is the schematic plan view of FIG. 2B, showing a twisting or rotation of the coating material storage bag inside the enclosure of the coating material cartridge, due to movement of the cartridge.

FIG. 3A is a schematic perspective view of a coating material storage bag orientation clip in accordance with an embodiment described herein.

DETAILED DESCRIPTION

Figure 1:
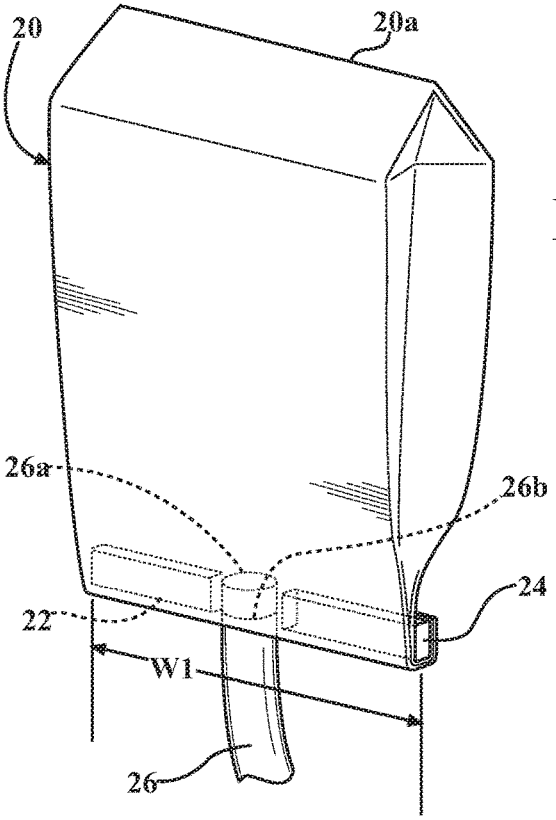
FIG. 1 is a perspective view of a known coating material storage bag which may be incorporated into an embodiment of a coating material cartridge in accordance with an embodiment described herein.

Embodiments described herein relate to a coating material cartridge defining an enclosure in which a coating material storage bag is received. The coating material storage bag receives and stores therein a coating material usable for an industrial coating process. The coating material storage bag may be positioned in a desired predetermined fixed orientation within the enclosure. A coating material storage bag orientation clip is secured to an element of the coating material cartridge to secure the coating material storage bag in the desired predetermined fixed orientation within the enclosure during filling of the coating material storage bag with coating material, and during movement of the coating material cartridge.

In the embodiments described herein, similar elements of different embodiments have similar reference characters or labels, unless otherwise stated.

FIG. 1 is a schematic perspective view of a known coating material storage bag 20 which may be incorporated into an embodiment of a coating material cartridge 30 in accordance with an embodiment described herein. The coating material storage bag 20 may be configured for receiving and storing a coating material (for example, paint) therein. The coating material stored in the bag may be extracted from the bag and applied to a surface during a coating process. A seam or edge 22 may be formed at a bottom of the bag 20, and a reinforcing rib 24 may be attached to the bag 20 along the seam 22 to add strength and rigidity to the portion of the bag 20 near the seam 22. A hollow coating material supply tube 26 may be connected to the coating material storage bag 20 to permit the bag to be filled with coating material, and to permit coating material to be extracted from the bag 20. An end 26*a* of the tube 26 may extend into the bag interior to enable fluid communication between the bag 20 interior and an exterior of the bag 20. The tube/bag contact interface 26*b* where the tube 26 enters the bag may be sealed in a known manner to prevent leakage of coating material from the bag 20. The bag 20 may be formed from a clear material (such as a transparent polymeric film, for example) to permit light from a a photoelectric sensor (or photosensor) to pass therethrough as described herein.

Figure 2A:
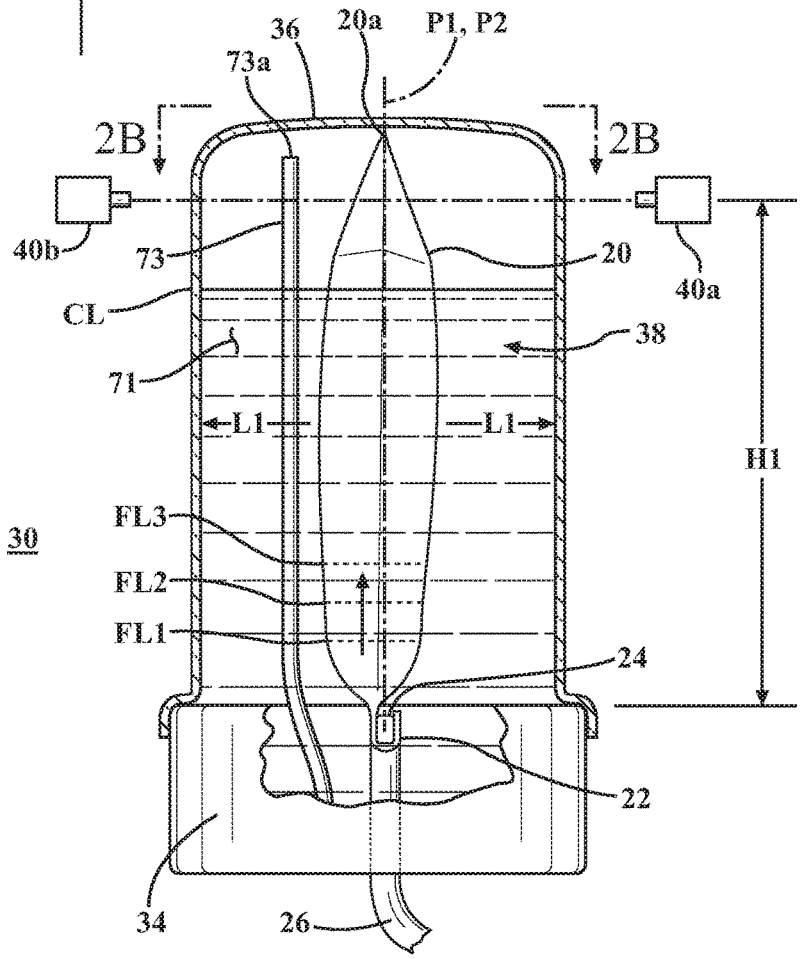
FIG. 2A is a schematic side partial-cutaway view of a known coating material cartridge containing a coating material storage bag as shown in FIG. 1.

FIG. 2A is a schematic side partial-cutaway view of a known coating material cartridge 30 usable for supplying a liquid coating material (for example, paint) to a coating station in a part manufacturing process. FIG. 2B is a plan view of the coating material cartridge 30 shown in FIG. 2A. In one or more arrangements, the coating material cartridge 30 may include a cartridge base 34 and a hollow body 36.

The cartridge base 34 may be configured for mounting on (or connection to) a coating spraying device (not shown), and may be formed from any suitable material. The body 36 may be formed from a transparent material (such as a transparent polymer) to permit the light from aphotosensor to pass therethrough as shown in FIGS. 2A and 2B. The photosensor may include an emitter 40*a* for transmitting a light beam and a receiver 40*b* for receiving the light beam from the emitter 40*a*. The receiver 40*b* may be aligned with the emitter 40*a* such that a light beam emitted from the emitter 40*a* passes through a central axis P2 of the material cartridge body 36 to reach the receiver 40*b*. The emitter 40*a* and receiver 40*b* may be positioned so that the light beam from the emitter 40*a* projects at a predetermined height H1 above the cartridge base 34 or with respect to some other reference. The height H1 or position of the photosensor is specified for use in measuring when a predetermined fill level is achieved in the bag 20.

Hollow body 36 may be attachable to the base 34 to define a fluid-tight enclosure 38 for a coating material storage bag 20 as previously described. The body 36 may be attached to the cartridge base 34 using a threaded interface or other attachment mechanism. The cartridge base/body attachment interface may be provided with a suitable gasket or other seal (not shown) to prevent leakage from the enclosure 38 formed by the connected cartridge base 34 and body 36.

The cutaway view of FIG. 2A shows a bag 20 positioned within the enclosure 38, with the bag seam 22 and reinforcing rib 24 visible. As seen in FIGS. 2A and 2B, the bag 20 may be positioned inside the enclosure 38 with a preferred, predetermined fixed orientation, in alignment with a vertical central plane P1 extending through the cartridge 30 when the cartridge is in an upright or vertical orientation as shown in FIG. 1, so that a width W1 (FIG. 1) of the bag 32 and/or the bag seam 22 extends along (or at least parallel to) the plane P1. Positioning of the bag 20 in the preferred, predetermined orientation may facilitate inspection of the coating material fill level FL by the photoelectric sensor 40*a*, 40*b*, and may also help ensure an uninterrupted or unrestricted flow of coating material out of the bag 20 during the coating process.

The tube 26 may be extended through an opening formed in the cartridge base 34, and then the coating material storage bag 20 may be positioned so as to reside within the cartridge enclosure 38 when the body 36 is attached to the cartridge base 34. A seal (not shown) may be provided between the tube 26 and the cartridge base 34 to prevent leakage between the tube 26 and the cartridge base 34. When the coating material storage bag 20 is positioned within the enclosure 38, the bag 20 may be filled under pressure with a coating material and transported to a coating station. The coating material may then be extracted from the coating material storage bag 20/cartridge 30 as needed during the coating process (i.e., the filled coating material cartridge 30 may serve as a mobile reservoir of coating material during the coating process).

The coating material storage bag 20 may be supported by or suspended in a compression fluid 71 inserted into the cartridge body 36. A pressure relief tube 73 may extend from the cartridge base 34 into the cartridge body 36. Tube 73 may have an open end 73*a* extending above a fluid level CL of the compression fluid 71 when the compression fluid resides in the cartridge body 36. A floatation element (not shown) may be attached to tube open end 73*a* to maintain the tube end above the fluid level CL as the fluid level rises and falls. In operation, as the coating material storage bag 20 fills with coating material, the compression fluid 71 is displaced in the cartridge body 36 and the fluid level CL rises. This may cause any air suspended in the cartridge body 36 over the compression fluid 71 to be compressed. Instead of being compressed, the air may be displaced into the tube open end 73*a* and then flow down the other end (not shown) of the tube 73 to where it is discharged.

Referring to FIGS. 2A and 2B, a photoelectric sensor 40*a*, 40*b* or other sensor may be positioned so that the sensor light beam will be broken by the bag uppermost portion 20*a* when the bag is not filled. FIG. 2A shows the bag 20 as the fill level increases from FL1 to FL2 then to FL3 during filling. As the bag fill level rises, the bag 20 spreads laterally outwardly within the enclosure 38 in directions indicated by arrows L1. This lateral expansion of the bag causes the uppermost portion 20*a* of bag 20 to gradually drop to a lower and lower level within the enclosure 38. Eventually, the bag 20 fills to a point where the bag uppermost portion 20 falls below the light beam emitted by the emitter 40*a*. At this point, the light beam is no longer broken, and receipt of the light beam by the receiver 40*b* may cause a signal to be generated to stop the flow of coating material into the bag 20.

In addition, during application of the coating material to a surface, the cartridge 30 may be attached to a robotic spraying arm (not shown) configured to apply the coating material, and the cartridge 30 may move along with the arm. In a conventional coating material cartridge, during filling of the coating material storage bag 20 and also during extraction of coating material from the bag 20, the bag 20 is unsecured within the enclosure 38 and is free to move within the enclosure 38, subject to forces acting on the bag 20 due to filling of the bag 20 and movement of the cartridge 30 by the robotic arm. Due to the forces applied to the bag 20, at least a portion of the bag 20 may rotate or twist inside the enclosure 38 as shown in the plan view of FIG. 2C, from an orientation M1 (dashed line) in alignment with plane P1 to an orientation M2 (solid line) which out of alignment with the plane P1 and also out of alignment with the emitter light beam. In such a case, the bag 20 will not fill because the light beam is not interrupted by the bag uppermost portion 20*a*. Also, an orientation such as orientation M2 may cause a portion of the bag 20 to obstruct the flow of coating material out of the bag 20 and into the tube 26 during extraction of the coating material.

Figure 3B:
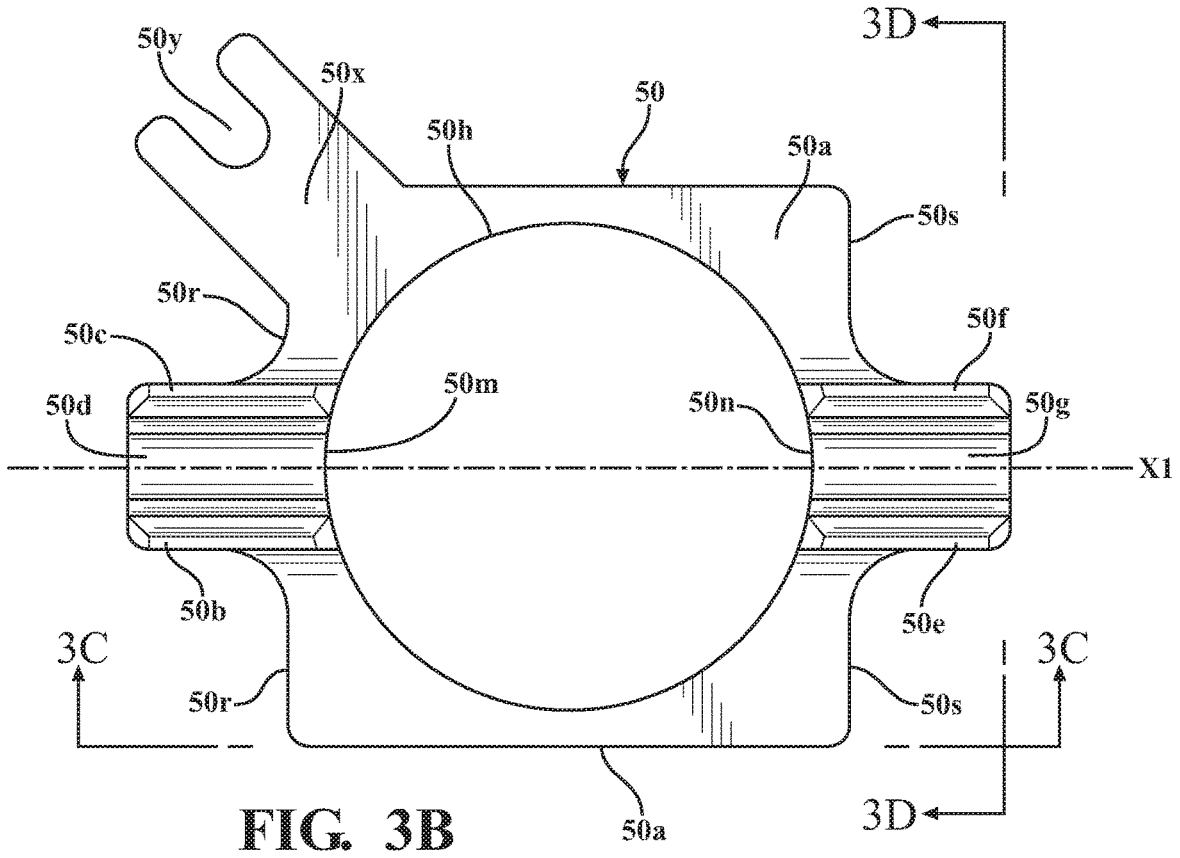
FIG. 3B is a schematic plan view of the clip shown in FIG. 3A.
Figure 3C:
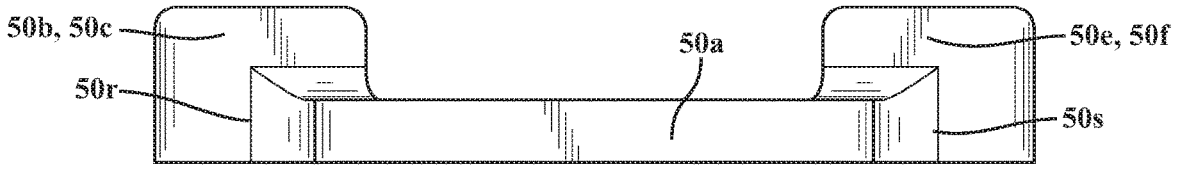
FIG. 3C is a schematic side view of the clip shown in FIG. 3A.
Figure 3D:
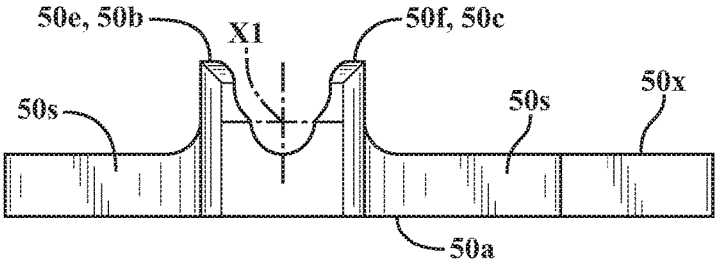
FIG. 3D is an end view of the clip shown in FIG. 3A.

FIG. 3A is a schematic perspective view of a coating material storage bag orientation clip 50 in accordance with an embodiment described herein. FIG. 3B is a schematic plan view of the clip shown in FIG. 3A. FIG. 3C is a schematic side view of the clip shown in FIG. 3A. FIG. 3D is a schematic end view of the clip shown in FIG. 3A. Referring to FIGS. 3A-3D, the coating material storage bag orientation clip 50 may include a clip base 50*a* and a first pair of opposed walls 50*b*, 50*c* extending from the clip base 50*a*. The first pair of opposed walls 50*b*, 50*c* may form a first slot 50*d* therebetween. The first slot 50*d* may have a longitudinal axis X1.

Figure 4A:
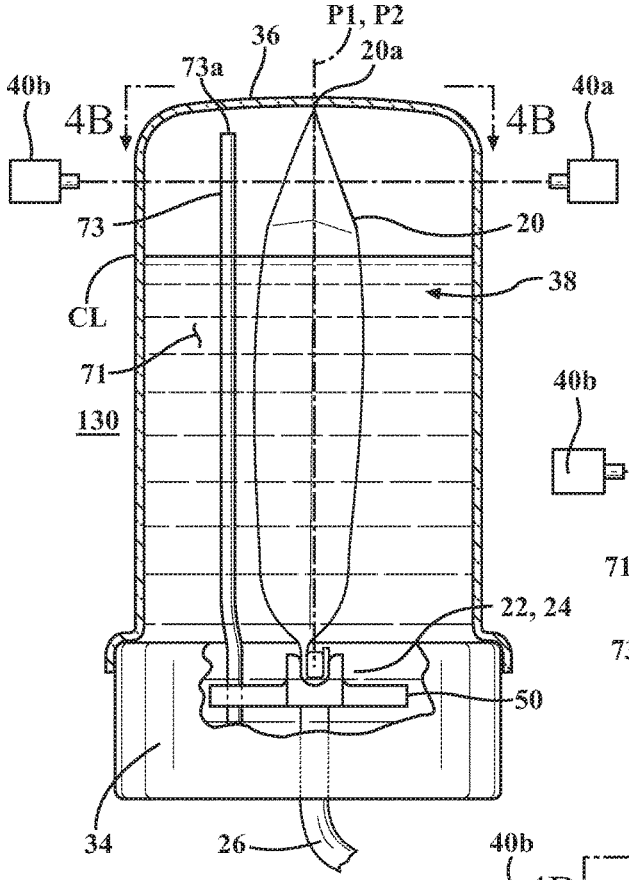
FIG. 4A is a schematic side partial-cutaway view of a coating material cartridge in accordance with an embodiment described herein, including a coating material storage bag and a coating material storage bag orientation clip as shown in FIGS. 3A-3D.
Figure 4B:
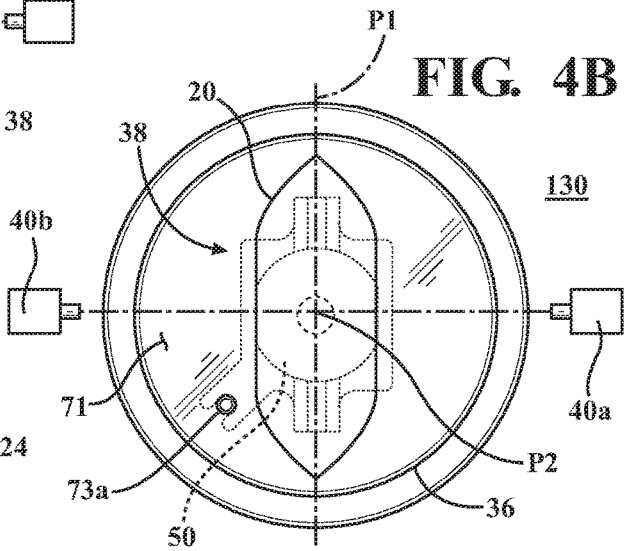
FIG. 4B is a schematic plan view of the coating material cartridge shown in FIG. 4A.
Figure 4C:
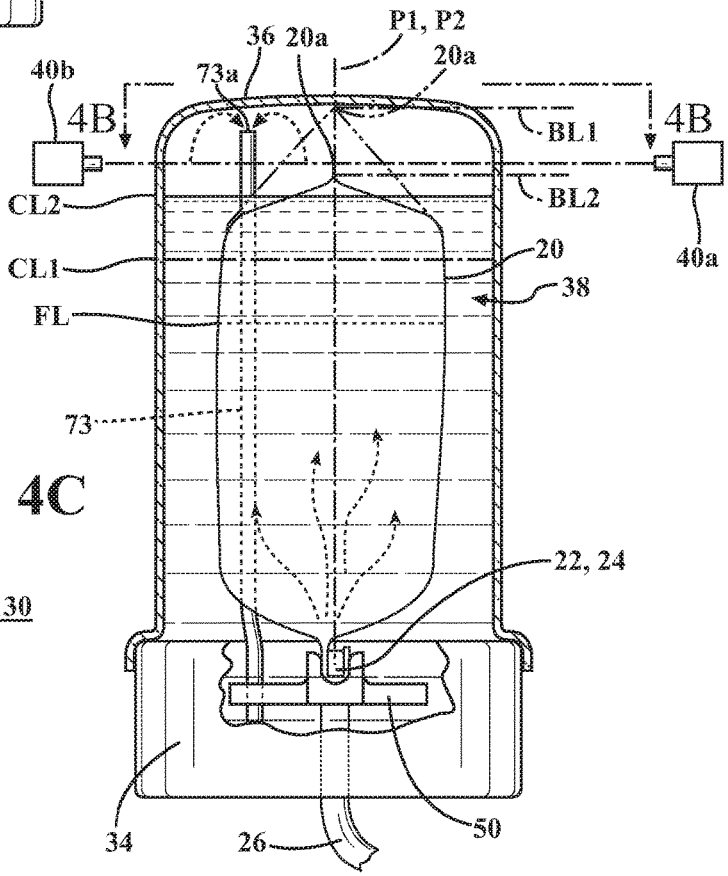
FIG. 4C is the view of FIG. 4A showing the coating material storage bag in a filled condition.

The clip 50 may be secured within the cartridge enclosure 38 (defined in another embodiment 130 of the coating material cartridge) as shown in FIGS. 4A-4C (described in greater detail below), with the first slot longitudinal axis X1 positioned so as to be coplanar with (or at least parallel with) the cartridge plane P1. The clip 50 may then engage a portion of the coating material storage bag 20 in the first slot 50*d* between the first pair of opposed walls 50*b*, 50*c* to maintain the storage bag 20 in the predetermined fixed orientation within the enclosure 38, during movement of the cartridge 130.

In one or more arrangements, the clip 50 may also include a second pair of opposed walls 50*e*, 50*f* extending from the base so as to form a second slot 50*g* therebetween. The second slot 50*g* may be spaced apart from the first slot 50*d* along the axis X1, and may be coaxially aligned with the first slot 50*d*. The second slot 50*g* may also receive therein a portion of the storage bag 20 to help maintain the storage bag 20 in the predetermined fixed orientation within the enclosure 38 during movement of the cartridge 130.

The clip 50 may further include a through-hole 50*h* formed in the clip base 50*a*. The through-hole 50*h* may be structured to receive the tube 26 therethrough when the bag 20 is positioned in the clip 50 as described herein. In one or more particular arrangements, and as seen in FIGS. 3A-3C, the first pair of opposed walls 50*b*, 50*c* may extend from the clip base 50*a* along a first side 50*m* of the through-hole 50*h*, and the second pair of opposed walls 50*e*, 50*f* may extend from the clip base 50*a* along a second side 50*n* of the through-hole 50*h* opposite the first side. Also, the first pair of opposed walls 50*b*, 50*c* may extend past a first edge 50*r* of the clip base 50*a*. In addition, the second pair of opposed walls 50*e*, 50*f* may extend past a second edge 50*s* of the clip base 50*a* opposite the first edge 50*r*.

The clip 50 may also have a clip orientation projection 50*x* extending from clip base 50*a* proximate first edge 50*r*. Orientation projection 50*x* may include a tube-receiving slot 50*y* formed therein. Referring to FIGS. 3A-4C, prior to inserting compression fluid 71 into the cartridge body 36, the pressure relief tube 73 may be fed into the slot 50*y* so as to engage the orientation projection 50*x*. The tube 73 may be secured in the slot 50*w* by an interference fit or by any other suitable means. Since the tube 73 extends from a fixed location in the cartridge base 34 into the slot 50*w*, the positioning of tube 73 in slot 50*y* aids preventing rotation or other movement of the clip, thereby anchoring or maintaining the clip 50 in a desired orientation within the cartridge 130. The clip 50, in the manner described herein, correspondingly maintains the coating material storage bag 20 in the preferred, predetermined orientation to facilitate detection of the bag uppermost portion 20*a* by the photoelectric sensor 40*a*, 40*b*.

FIG. 4A is a schematic side partial-cutaway view of a coating material cartridge 130 having a clip 50 as shown in FIGS. 3A-3D positioned and secured therein, and showing the bag 20 prior to filling. Otherwise, the cartridge 130 may be structured the same as the cartridge 30 previously described. FIG. 4B is a schematic plan view of the cartridge shown in FIG. 4A. FIG. 4C is the view of FIG. 4A showing the bag 20 in a filled condition (to fill level FL). FIGS. 4A-4C show the cartridge with the clip 50 positioned and secured in the enclosure 38 such that the slot axis X1 extends along (or is at least parallel with) the plane P1. The clip 50 may be secured to the cartridge base 34 or to any other suitable portion of the cartridge 130.

Referring to FIGS. 4A-4C, the coating material storage bag 20 may be supported or suspended in compression fluid 71 as previously described. Tube open end 73*a* may extend above an initial fluid level CL1 of the compression fluid 71 when the compression fluid resides in the cartridge body 36. In operation, as the coating material storage bag 20 fills with coating material, the compression fluid 71 is displaced in the cartridge body 36 and the fluid level rises, from a relatively lower level CL1 to a relatively higher level CL2. This may cause air suspended in the cartridge body 36 over the compression fluid 71 to be displaced into the tube open end 73*a* and then flow down the other end (not shown) of the tube 73 to where it is discharged, as previously described.

FIGS. 4A and 4C also show a coating material storage bag 20 received in the enclosure 38 with the seam 22 and rib 24 received in the slots 50*d* and 50*g*. The slot(s) 50*d* and 50*g* may be configured to receive the bag seam 22 and (optionally) the reinforcing rib 24 therein. The tube 26 may extend through the cartridge base 34, through the clip through-hole 50*h* and into the bag 20. During movement of the cartridge, the seam 22 and rib 24 may be maintained in the slot(s) 50*d* and 50*g* by an interference fit and/or by the weight of the filled bag 20. This maintains the bag 20 in the preferred, predetermined fixed orientation during movement of the cartridge 130. In addition, engagement of the pressure relief tube 73 with the clip orientation projection 50*x* maintains the clip 50 in an orientation which secures the coating material storage bag 20 in the preferred, predetermined orientation to facilitate inspection of the coating material fill level FL by the photoelectric sensor 40*a*, 40*b*.

Referring to FIG. 4C, as the bag 20 fills, the level of bag uppermost portion 20*a* drops from the level BL1 shown in phantom (at which the bag uppermost portion 20*a* breaks the light beam of sensor 40*a*, 40*b*) to a level BL2 shown as a solid line (at which the uppermost portion 20*a* resides below the sensor light beam). When the bag uppermost portion 20*a* reaches the level BL2 and the sensor light beam is no longer interrupted, the bag 20 is considered to be filled with coating material. A signal is then generated to stop filling of the bag 20.

In the above detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g. AB, AC, BC or ABC).

Aspects herein can be embodied in other forms without departing from the spirit or essential attributes thereof. Accordingly, reference should be made to the following claims, rather than to the foregoing specification, as indicating the scope of the invention.

What is claimed is:

1. A coating material cartridge comprising:

an enclosure;

a coating material storage bag received in the enclosure;

a pressure relief tube extending into the enclosure; and a coating material storage bag orientation clip secured within the enclosure, wherein the clip engages a portion of the coating material storage bag to maintain the storage bag in a predetermined fixed orientation within the enclosure, the clip including a base, a clip orientation projection extending from the base, and a slot formed in the clip orientation projection, wherein the pressure relief tube is received in the clip orientation projection slot to engage the pressure relief tube with the clip, and wherein engagement between the clip and the pressure relief tube maintains the clip in an orientation within the cartridge in which the coating material storage bag is in the predetermined fixed orientation within the enclosure.

2. The coating material cartridge of claim 1 wherein the clip comprises a first pair of opposed walls extending from the base, the first pair of opposed walls forming a first slot therebetween, and wherein the portion of the coating material storage bag is received within the first slot to engage the coating material storage bag with the clip.

3. The coating material cartridge of claim 2 wherein the clip includes a second pair of opposed walls extending from the base so as to form a second slot therebetween, wherein the second slot is spaced apart from the first slot, and wherein another portion of the coating material storage bag is received within the second slot to engage the coating material storage bag with the clip.

4. The coating material cartridge of claim 3 wherein the second slot is coaxially aligned with the first slot.

5. The coating material cartridge of claim 2 wherein the clip further comprises a through-hole formed in the base, and wherein a coating material supply tube extends into the through-hole.

6. The coating material cartridge of claim 5 wherein the first pair of opposed walls extends from the base along a first side of the through-hole, wherein the clip includes a second pair of opposed walls extending from the base so as to form a second slot therebetween, the second pair of opposed walls extending from the base along a second side of the through-hole opposite the first side, and wherein another portion of the coating material storage bag is received within the second slot to engage the coating material storage bag with the clip.

7. A coating material storage bag orientation clip comprising:

a base;

a first pair of opposed walls extending from the base, the first pair of opposed walls forming a first slot therebetween, the first slot being configured to retain therein a portion of a coating material storage bag; and a clip orientation projection extending from the base at an acute angle with respect to a longitudinal axis of the first slot, the clip orientation projection being coplanar with the base.

8. The coating material storage bag orientation clip of claim 7 wherein the clip includes a second pair of opposed walls extending from the base so as to form a second slot therebetween, and wherein the second slot is spaced apart from the first slot, and wherein the clip orientation projection includes a third slot extending at an acute angle with respect to the first slot longitudinal axis.

9. The coating material storage bag orientation clip of claim 8 wherein the second slot is coaxially aligned with the first slot.

10. The coating material storage bag orientation clip of claim 8 wherein the clip further comprises a through-hole formed in the base, and wherein the first pair of opposed walls extends from the base along a first side of the through-hole, the second pair of opposed walls extending from the base along a second side of the through-hole opposite the first side.

11. The coating material storage bag orientation clip of claim 7 wherein the first pair of opposed walls extends past an edge of the base.

* * * * *